United States Patent [19]

Ijiri et al.

[11] Patent Number: 4,771,179

[45] Date of Patent: Sep. 13, 1988

[54] SHIELDING ARTICLE

[75] Inventors: Yasuo Ijiri, Itami; Kotaro Mio, Ikeda, both of Japan

[73] Assignee: Dainichi-Nippon Cables, Ltd., Hyogo, Japan

[21] Appl. No.: 708,615

[22] Filed: Mar. 5, 1985

[30] Foreign Application Priority Data

Mar. 5, 1984 [JP] Japan ..... 59-31911

[51] Int. Cl.[4] ..... G21F 1/12

[52] U.S. Cl. ..... 250/519.1; 250/515.1; 428/645; 428/650; 428/635

[58] Field of Search ..... 428/594, 635, 636, 645, 428/650; 250/515.1, 516.1, 517.1, 518.1, 519.1

[56] References Cited

U.S. PATENT DOCUMENTS

| | | | |
|---|---|---|---|
| 1,079,035 | 11/1913 | Tebbetts | 428/645 |
| 1,280,908 | 10/1918 | Wales et al. | 428/645 |
| 1,611,031 | 12/1926 | Henderson | 250/519.1 |
| 2,640,937 | 6/1953 | Munday | 250/519.1 |
| 2,858,451 | 10/1958 | Silversher | 250/515.1 |
| 2,928,948 | 3/1960 | Silversher | 250/515.1 |
| 3,050,410 | 8/1962 | Greene | 428/650 |
| 3,239,669 | 3/1966 | Weinberger | 250/519.1 |
| 3,984,645 | 10/1976 | Collica et al. | 250/519.1 |
| 4,196,355 | 4/1980 | Maine | 250/519.1 |
| 4,432,932 | 2/1984 | Jacobson | 250/519.1 |

FOREIGN PATENT DOCUMENTS

| | | | |
|---|---|---|---|
| 523755 | 11/1953 | Belgium . | |
| 2063430 | 12/1970 | Fed. Rep. of Germany . | |
| 20240 | 8/1968 | Japan | 250/517.1 |
| 123360 | 10/1978 | Japan | 428/645 |
| 698265 | 10/1953 | United Kingdom | 428/645 |

OTHER PUBLICATIONS

Translation of Japanese Kokai Patent No. 53-123360.

*Primary Examiner*—John J. Zimmerman

*Attorney, Agent, or Firm*—Armstrong, Nikaido, Marmelstein & Kubovcik

[57] ABSTRACT

A shielding article assembled by piling a plurality of multilayer sheets and fastening the sheets at one or both end portions, the multilayer sheet comprising an aluminium layer and a lead layer, wherein the thickness of the aluminium layer, the lead layer and the multilayer sheet are 10 to 100 μm, twice the aluminium layer and 50 to 400 μm, respectively. The shielding article is useful for shielding radioactive rays or sound and has excellent mechanical properties and heat resistance.

3 Claims, 1 Drawing Sheet

SHIELDING ARTICLE

BACKGROUND OF THE INVENTION

The present invention relates to a shielding article, and more particulary, to a shielding article used for shielding radioactive rays such as gamma ray and X-ray, sound, or the like.

A shielding article assembled by piling a plurality of lead sheets has hitherto been proposed. Such a shielding article is used in a manner that the shielding article is hung down like a curtain or attached along a pipe or other structures. However, the shielding article has the following serious disadvantages.

(1) When hanging the shielding article, the shielding aticle is torn out due to its own weight, since lead has a high specific gravity and a low mechanical strength.

(2) When carrying and storing the shielding article or when repeatedly bending or folding the article, the lead sheet causes buckling, which leads to breakage and serious wrinkles of the lead sheet. Therefore, such a shielding article cannot be repeatedly used.

An object of the present invention is to provide a shielding article which has no problem mentioned above and comprises multilayer sheets of an alminium layer and a lead layer having the particular structure, the multilayer sheets being piled and fastened at one or both end portions.

The above and other objects and advantages of the present invention will become apparent from the following description.

SUMMARY OF THE INVENTION

In accordance with the present invention, there is provided a shielding article assembled by piling a plurality of multilayer sheets and fastening the piled sheets at one or both end portions thereof, the multilayer comprising at least one aluminium layer and at least one lead layer which being bonded to one or both sides of the aluminium layer, wherein the aluminium layer has a total thickness of 10 to 100 μm, the lead layer has a total thickness at least twice thicker than the aluminium layer, and the multilayer sheet has a thickness to 50 to 400 μm.

DETAILED DESCRIPTION OF THE INVENTION

Figure 1:
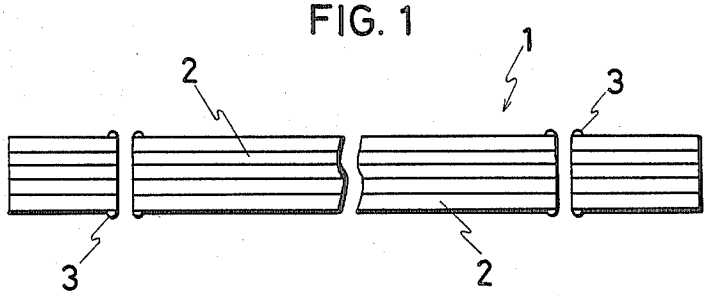
FIG. 1 is a sectional view showing an embodiment of the shielding article of the present invention.
Figure 2:
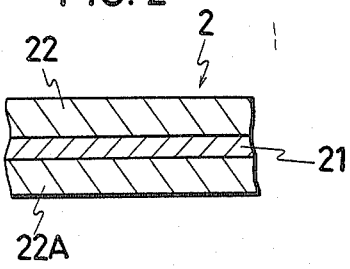
FIG. 2 is a partially enlarged sectional view of a multilayer sheet used in the present invention.

In FIG. 1, a shielding article 1 has a plurality of multilayer sheets 2 and are assembled by piling the sheets 2 and by fastening the sheets 2 to each other at both end portions with fasteners 3. As shown in FIG. 2, the multilayer sheet 2 is formed by bonding lead layers 22, 22A to both sides of an aluminium layer 21.

The aluminium layer is provided for obtaining an improved tensile strength and bending endurance of the multilayer sheet. Therefore, when hanging, the shielding article of the present invention can be prevented from being torn out due to the weight of itself. Further, even if the shielding article is repeatedly bent and folded, bucklings and serious wrinkles are hardly formed or not formed. Those advantages allow to use the article repeatedly for a long time.

As the aluminium layer, there may be employed one or more aluminium foils or sheets made of a pure aluminium or an aluminium alloy. Examples of the pure aluminium are, for instance, an aluminium ingot having a purity of not less than 97% (% by weight, hereinafter the same) such as a virgin aluminium ingot of the first, the second or the third class defined in JIS H 2102 (1968), a secondary aluminium ingot of the first, the second or the third class defined in JIS H 2103 (1965), and the like. Examples of the aluminium alloy are, for instance, an aluminium alloy containing the other metal element such as Cu, Mg, Si, Fe, Zn or Mn in an amount of 3 to 10%. As the aluminium foil or sheet, there are employed various aluminium sheets defined in JIS H 4000 (1982), various aluminium foils defined in JIS H 4160 (1974), an electrolytic aluminium foil, a rolled aluminium foil, and the like, preferably aluminium foils defined in JIS H 4160 (1974). Preferable aluminium layer is made of a rolled aluminium foil of the pure aluminium having a purity of not less than 97%, particularly not less than 99%.

The multilayer sheet may include two or more aluminium layers. In such a case, each aluminium layer may be bonded via the lead layer.

A thickness of the aluminium layer or, in case where two or more aluminium layers are employed, a total thickness of the layers is 10 to 100 μm, preferably 25 to 60 μm. When the thickness is less than 10 μm, the above advantages cannot be obtained. When the thickness is more than 100 μm, since the thickness of the multilayer sheet must be 50 to 400 μm as mentioned above, the lead layer becomes thinner, and thus sufficient shielding effect against the radioactive rays, sound, or the like cannot be obtained.

The lead layer may be made of a pure lead or a lead alloy. Examples of the pure lead are, for instance, pure leads of not less than 99.5% in purity such as six kinds of pig lead defined in JIS H 2105 (1955). Preferable purity of the pig lead is not less than 99.8 %, particularly not less than 99.9%. A lead alloy having a similar flexibility to the pure lead may be employed. For shielding radioactive rays, it is preferable to employ a lead alloy having a specific gravity of not less than 10. Examples of the lead alloy are, for instance, an alloy of lead with Cu, Fe, Zn, Ag, Sn, Sb, and the like in an amount of 0.5 to 50%.

The lead layer is provided for obtaining the shielding effect against the radioactive rays, sounds, or the like. The lead layer may be bonded to one or both sides of the aluminium layer, and when two or more aluminium layers are emlployed, the lead layer may also be provided between the aluminium layers. The thickness of the lead layer or the total thickness of the layers must be at least twice the thickness of the aluminium layer. When the thickness is less than twice the thickness of the aluminium layer, the desired shielding effect cannot be obtained.

The multilayer sheet must be 50 to 400 μm, preferably 60 to 300 μm in thickness. When the thickness of the multilayer sheet is less than 50 μm, it is difficult to use repeatedly the shielding article, since serious wrinkles tend to be produced by bending or folding, even if the multilayer sheet has the aluminium layer. When the thickness is more than 400 μm, the multilayer sheet becomes too rigid.

The lead layer is bonded to the aluminium layer by pressing a lead foil or sheet to the aluminium layer, by adhering with an adhesive, by hot dipping, by electroplating, or the like. The aluminium layer may be subjected to pre-treatment such as zincate treatment, metal galvanizing treatment, or both treatments prior to the bonding.

In case of the hot dipping, the lead alloy is preferably employed, since the lead alloy is generally better than the pure lead in an affinity or an adhesive property to aluminium.

In case of the pressing or adhering, the pure lead or the lead alloy may be employed. However, the pure lead is more preferably employed, since the pure lead is generally better than the lead alloy in flexibility and density (density of the pure lead is higher than that of the lead alloy, and therefore the shielding effect against the radioactive rays is better). Particularly, it is preferable in industrial use that the pure lead sheet is adhered to the aluminium foil with the adhesive described hereinbelow.

As the adhesive, an organic adhesive or an inorganic adhesive can be employed. Examples of the organic adhesive are, for instance, urethane adhesives, two component acrylic adhesives, acrylonitrile-butadiene adhesives, epoxy adhesives, and the like. Examples of the inorganic adhesive are, for instance, silicate adhesives, phosphate adhesives, and the like.

In the shielding article of the present invention, the multilayer sheet may comprise two or more aluminium layers and two or more lead layers as mentioned above. In such a case, the total thickness of the aluminium layers, the total thickness of the lead layers and the thickness of the multilayer sheet must satisfy the requirements respectively defined above.

In the above-described embodiment, though the piled multilayer sheets 2 are fastened to each other with the fasteners 3 at the both end portions, the multilayer sheets may be fastened at one end portion. The piled multilayer sheets may be tightly secured or may be loosely fastened to each other.

As the material of the fastener, there can be employed stainless steel, brass galvanized with Ni, iron or aluminium, and the like. Particularly, stainless steel or brass galvanized with Ni is preferably employed.

Figure 3:
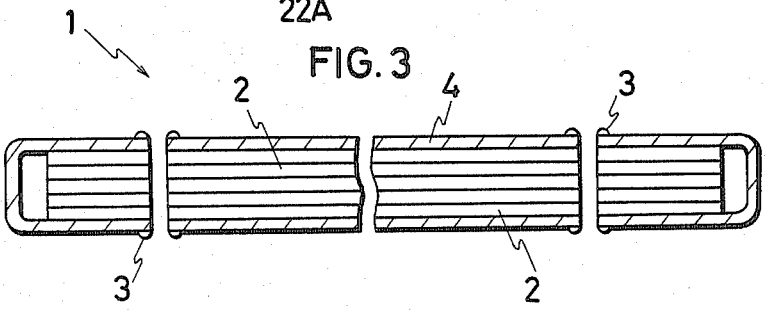
FIG. 3 is a sectional view showing the shielding article shown in FIG. 1 enveloped in a cloth bag.
Figure 4:
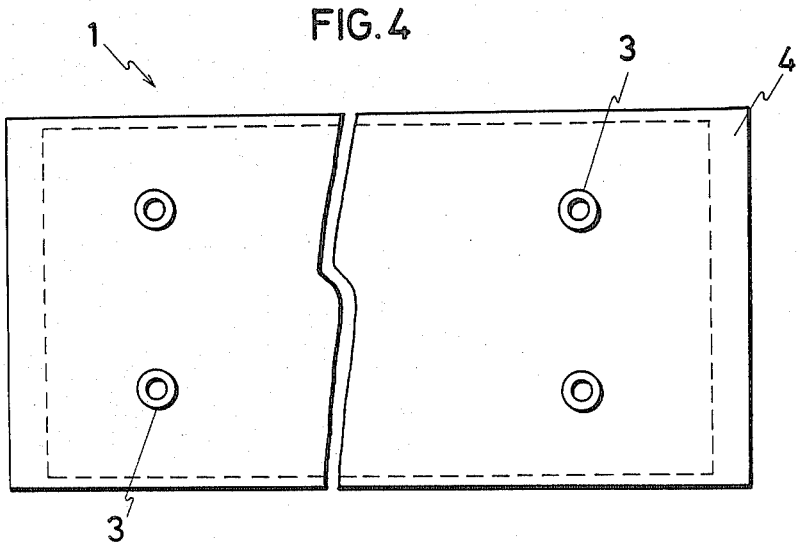
FIG. 4 is a plan view of the shielding article shown in FIG. 3.

A plurality of multilayer sheets 2 may be enveloped in a cloth bag 4, as shown in FIGS. 3 and 4. In this embodiment, the multilayer sheets 2 are fastened to each other and also to the cloth bag 4 with the fasteners 3 at both end portions.

When the shielding article of the present invention is used for shielding the radioactive rays, the cloth bag 2 has preferably not only a resistance against radioactive rays but also a water tightness, because radioactive dusts deposited to the cloth bag 4 must be washed away with water. It is particularly preferable to make the cloth bag completely water tight by treating the all surfaces of the bag (including the seams) with a water proof agent for preventing water from passing through the cloth. Examples of the water tight cloth are, for instance, a glass cloth coated with silicone rubber, and the like. Examples of the water proof agent are, for instance, one component silicone rubbers of a condensation (deoxime type, deacid type, dealcohol type, or the like) polymerization type or an addition polymerization type, two component silicone rubbers such as a cure type with a peroxide.

The multilayer sheet is preferably 100 to 1,000 mm in width and 500 to 2,000 mm in length, and more preferably 200 to 500 mm in width and 800 to 1,500 mm in length.

The shielding article of the present invention comprises a plurality of the multilayer sheets. The number of multilayer sheets is optionally selected depending on the conditions to be shielded. For shielding the radioactive sources, a sufficient shielding effect can be obtained in general by piling the multilayer sheets so as to be not less than about 2 mm in total lead thickness, e.g. piling 10 to 40 sheets of the multilayer sheets.

Since the multilayer sheet in the present invention substantially comprises metal layers, the sheet also has an excellent heat resistance. Therefore, the shielding article of the present invention can be always put on or hung down near a harmful source of a high temperature.

The present invention is more specifically described and explained by means of the following Examples. It is to be understood that the present invention is not limited to those Examples and various changes and modifications may be made to the present invention without departing from the spirit and scope thereof.

EXAMPLES 1 TO 2

An aluminium foil (purity: not less than 99.7%, A1N30H-0 defined in JIS H 4160 (1974)) having a thickness shown in Table 1 was subjected to zincate treatment and Cu-galvanizing treatment. The pre-treated aluminium foil was dipped into a molten lead alloy with Sn (Pb:Sn=90:10 by weight), and then coated with the lead alloy having a thickness shown in Table 1 to prepare a multilayer sheet according to the present invention.

Twenty of the multilayer sheets (width: 20 cm, length: 60 cm) were enveloped in a cloth bag prepared with a glass cloth coated with silicone rubber, and then fastened with a fastener to give the shielding article of the present invention as shown in FIGS. 3 and 4.

EXAMPLES 3 TO 5

A pure lead sheet (purity: not less than 99.8%, the 4th class pig lead defined in JIS H 2105 (1955)) having a thickness shown in Table 1 was adhered to both sides of an aluminium foil (purity: not less than 99.3%, AlN30H-0 defined in JIS H 4160 (1974)) having a thickness shown in Table 1 by using a thermosetting polyurethane adhesive to prepare a multilayer sheet according to the present invention.

Twenty of the multilayer sheets (width: 20 cm, length: 60 cm) were enveloped in a cloth bag prepared with a glass cloth coated with silicone rubber, and then fastened with a fastener to give the shielding article of the present invention as shown in FIGS. 3 and 4.

COMPARATIVE EXAMPLE 1

The procedures in Example 1 were repeated except that an aluminum foil having a thickness of 30 μm was employed to prepare a comparative multilayer sheet having a lead alloy layer of 10 μm in thickness on each side of the aluminium foil. By employing twenty of the sheets, a comparative shielding article was assembled in the same manner as in Example 1.

COMPARATIVE EXAMPLE 2

The procedures in Example 3 were repeated except that an aluminium foil having a thickness of 8 μm was employed to prepare a comparative multilayer sheet having a lead alloy layer of 40 μm in thickness on each side of the aluminium foil. By employing twenty of the sheets, a comparative shielding article was assembled in the same manner as in Example 3.

COMPARATIVE EXAMPLE 3

Twenty pure lead foils having a thickness of 60 μm were enveloped in a cloth bag in the same manner as in Example 1 to give a comparative shielding article.

With respect to the shielding articles, folding endurance, shielding effect and tensile strength were measured according to the following tests. The results are shown in Table 1.

Folding endurance

The article to be tested was subjected to the fold-extension operation 50 times, and then the surface apperance of the article was observed with naked eyes. In Table 1, O and X show the following apperances.

O: No breakage

X: Partially broken

Shielding effect

Radiation dose of gamma ray penetrating through a shielding article from a radiation source was measured. Each shielding effect of the articles was estimated as an index on the basis of the index (100) which corresponds to the radiation dose determined by employing a pure lead sheet (purity: not less than 99.8%, the 4th class defined in JIS H 2105 (1955)) having a thickness of 2 mm.

TABLE 1

| Example | Multilayer sheet: Thickness of aluminium foil (μm) | Multilayer sheet: Thickness of each lead layer (μm) | Multilayer sheet: Total thickness (μm) | Folding endurance | Shielding efficiency | Tensile strength (kg/15 mm width) |
|---|---|---|---|---|---|---|
| Example 1 | 10 | 40 | 90 | O | 85 | 2.0 |
| Example 2 | 25 | 40 | 105 | O | 88 | 3.5 |
| Example 3 | 10 | 60 | 150 | O | 121 | 2.8 |
| Example 4 | 50 | 100 | 270 | O | 205 | 8.6 |
| Example 5 | 20 | 25 | 90 | O | 57 | 2.6 |
| Comparative Example 1 | 30 | 10 | 50 | O | 20 | 3.1 |
| Comparative Example 2 | 8 | 40 | 108 | O | 83 | 1.5 |
| Comparative Example 3 | pure lead foil of 60 μm in thickness | | 60 | X (partially breaking) | 60 | 0.8 |

Tensile strength

According to the procedures defined in JIS C 2318 (1972), tension test was conducted at a tension rate of 10 mm/min.

What is claimed is:

1. A radiation shielding article assembled by piling a plurality of multilayered sheets and fastening the piled sheets at one or both end portions thereof before or after enveloping said piled sheets in a cloth bag; each multilayered sheet comprising an aluminum layer and two lead layers which are bonded to both sides of said aluminum layer, wherein said aluminum layer is made of a pure aluminum having a purity of not less than 99% by weight and has a thickness of 10 to 100 μm, said lead layers are made of a pure lead having a purity of not less than 99.5% by weight and has a total thickness at least twice that of said aluminum layer, said multilayered sheet has a thickness of 60 to 300 μm, and said cloth bag has a resistance against radioactive rays and a water tightness.

2. The shielding article of claim 1, wherein said piled multilayer sheets are fastened at both end portions.

3. The shielding article of claim 1, wherein said piled sheets are fastened together with said cloth bag.

* * * * *